US009448499B2

(12) United States Patent
Kihira et al.

(10) Patent No.: US 9,448,499 B2
(45) Date of Patent: Sep. 20, 2016

(54) ELECTROPHOTOGRAPHIC TONER USING BIOPLASTIC AND METHOD OF PRODUCING THE SAME

(71) Applicant: CASIO COMPUTER CO., LTD., Shibuya-ku, Tokyo (JP)

(72) Inventors: Kenji Kihira, Kiyose (JP); Hideki Ikeda, Hamura (JP); Yuichiro Iegaki, Kodaira (JP); Yuta Kan, Tokorozawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/611,867

(22) Filed: Feb. 2, 2015

(65) Prior Publication Data

US 2015/0261109 A1 Sep. 17, 2015

(30) Foreign Application Priority Data

Mar. 17, 2014 (JP) ..... 2014-054118

(51) Int. Cl.
*G03G 9/087* (2006.01)
*G03G 9/08* (2006.01)

(52) U.S. Cl.
CPC ..... *G03G 9/08* (2013.01); *G03G 9/081* (2013.01); *G03G 9/08748* (2013.01); *G03G 9/08755* (2013.01); *G03G 9/08795* (2013.01)

(58) Field of Classification Search
CPC ..... G03G 9/08746; G03G 9/08748
See application file for complete search history.

(56) References Cited

U.S. PATENT DOCUMENTS

2001/0003636 A1 6/2001 Suwa et al.
2003/0165764 A1 9/2003 Suwa et al.
2012/0295196 A1* 11/2012 Urban ..... G03G 9/08711 430/111.4
2014/0023965 A1 1/2014 Chiba et al.
2014/0170552 A1* 6/2014 Shintou ..... G03G 9/0906 430/108.21

FOREIGN PATENT DOCUMENTS

JP 2000242030 A 9/2000
JP 2001166537 A 6/2001
JP 2003248339 A 9/2003
JP 2006070057 A 3/2006
JP 2011095471 A 5/2011
JP 2012032628 A 2/2012
JP 2012145642 A 8/2012
JP 2014028882 A 2/2014
JP 2014041324 A 3/2014

OTHER PUBLICATIONS

Japanese Office Action (and English translation thereof) dated Feb. 16, 2016, issued in counterpart Japanese Application No. 2014-054118.
Japanese Office Action (and English translation thereof) dated May 10, 2016, issued in Japanese Application No. 2014-054118.

* cited by examiner

*Primary Examiner* — Hoa V Le
(74) *Attorney, Agent, or Firm* — Holtz, Holtz & Volek PC

(57) ABSTRACT

An electrophotographic toner having good grindability, and excellent fixability and durability, and a method of producing the same are provided. The electrophotographic toner includes an amorphous bioplastic having a weight average molecular weight (Mw) of 30,000 to 100,000, and at least one of a phenol resin and a terpene phenol resin as a grinding aid.

9 Claims, 2 Drawing Sheets

ELECTROPHOTOGRAPHIC TONER USING BIOPLASTIC AND METHOD OF PRODUCING THE SAME

CROSS-REFERENCE TO RELATED APPLICATION

This application is based upon and claiming the benefit of priority from prior Japanese Patent Application No. 2014-054118, filed Mar. 17, 2014, the entire contents of which are incorporated herein by reference.

FIELD

The present invention relates to an electrophotographic toner using a bioplastic, and a method of producing the same.

BACKGROUND

Image formation by an electrophotographic method includes developing an electrostatic image with a toner to visualize the image, transferring the toner image thus obtained onto a sheet, and then fixing the toner image by applying heat and pressure thereto. The toner is produced by melting and kneading a mixture containing a binder resin, a colorant, and a charge control agent or the like, and grinding and classifying the resultant mixture to adjust the particle size distribution. Petroleum resins such as a styrene-acrylic resin and a polyester resin are conventionally used as the binder resin of the toner.

In recent years, use of a biodegradable resin having a small load on the environment upon disposal or a biomass plastic made from a recyclable resource as a resin for toners has been proposed from the standpoint of environmental friendliness. Biomass plastics and biodegradable plastics which can effectively utilize limited resources and contribute to a reduction in an environment load are called bioplastics.

At present, one of the most promising bioplastic resins is polylactic acid. The polylactic acid is a crystalline polyester having a melting point of about 170° C., a glass transition point of about 60° C., and a weight average molecular weight (Mw) of about 100,000 to about 150,000. The use of such polylactic acid to which heat resistance and high durability are imparted has also been started as a material of a casing of a mobile phone or the like.

However, when the above polylactic acid is used alone as a toner resin, it is disadvantageously hard, causing poor grindability, and has a disadvantageously high softening temperature, thus is not suitable for low-temperature fixing.

Jpn. Pat. Appin. KOKAI Publication No. 2003-248339 describes that good low-temperature fixability is attained without impairing durability by blending a specific polylactic acid-based biodegradable resin with a terpene-phenol copolymer and a predetermined amount of wax having a melting point equal to or lower than the softening temperature of the resin. However, the use of polylactic acid described in the Examples of the gazette makes it difficult to attain high grindability.

Jpn. Pat. Appin. KOKAI Publication No. 2014-041324 describes that a phenol-based condensation product or a phenol resin is used as a charge control agent in a toner containing a biodegradable resin as a binder resin. However, the gazette does not refer to grindability in a toner producing process.

Jpn. Pat. Appin. KOKAI Publication No. 2012-032628 proposes that polylactic acid is hydrolyzed to have a smaller molecular weight so as to improve grindability. However, the hydrolysis of the polylactic acid requires a long processing time, which causes a great burden in terms of workability and cost.

SUMMARY

The present invention has been made in view of the above-described circumstances. It is an object of the present invention to provide an electrophotographic toner containing an amorphous bioplastic as a binder resin and having good grindability, and excellent fixability and durability, and a method of producing the same.

In order to attain the above-mentioned object of the present invention, an electrophotographic toner according to the present invention contains an amorphous bioplastic having a weight average molecular weight (Mw) of 30,000 to 100,000, and at least one of a phenol resin and a terpene phenol resin as a grinding aid.

In order to attain the above-mentioned object of the present invention, a method of producing an electrophotographic toner according to the present invention includes melt-kneading a mixture containing an amorphous bioplastic having a weight average molecular weight (Mw) of 30,000 to 100,000 and at least one of a phenol resin and a terpene phenol resin as a grinding aid to obtain a kneaded product, and grinding the kneaded product after hardened.

In the electrophotographic toner according to the present invention constituted as described above, the amorphous bioplastic preferably has a weight average molecular weight (Mw) of 50,000 to 80,000.

In the electrophotographic toner according to the present invention constituted as described above, a total amount of the grinding aid preferably falls within a range of 10 to 60% by mass of a mass of the toner. The total amount of the grinding aid more preferably falls within a range of 10 to 30% by mass of the mass of the toner, and optimally falls within a range of 20 to 25% by mass of the mass of the toner.

In the electrophotographic toner according to the present invention constituted as described above, an amount of the phenol resin preferably falls within a range of 5 to 20% by mass of the mass of the toner.

Preferably, the phenol resin or the terpene phenol resin has a weight-average degree of polymerization falling within a range of 500 to 5,000, and the toner contains both the phenol resin and the terpene phenol resin as the grinding aid. At this time, the amount of the phenol resin preferably falls within a range of 5 to 20% by mass of the mass of the toner.

In the electrophotographic toner according to the present invention constituted as described above, the amorphous bioplastic preferably is amorphous polylactic acid.

Thus, the present invention can provide an electrophotographic toner containing an amorphous bioplastic as a binder resin and having excellent grindability, fixability, and durability, and a method of producing the same.

BRIEF DESCRIPTION OF THE DRAWINGS

A more complete understanding of this application can be obtained when the following detailed description is considered in conjunction with the following drawings, in which.

DETAILED DESCRIPTION

Hereinafter, an embodiment of the present invention will be described.

Generally, in the production of an electrophotographic toner using the crystalline bioplastic as a binder resin, if the molecular weight of a crystalline bioplastic is not considerably decreased, it is difficult to attain high grindability.

The present inventors found that the combination of an amorphous bioplastic and at least one of a phenol resin and a terpene phenol resin can attain high grindability even if the molecular weight of the bioplastic is not so small, leading to the completion of the present invention.

That is, an electrophotographic toner according to the embodiment of the present invention contains an amorphous bioplastic having a predetermined weight average molecular weight (Mw), and at least one of a phenol resin and a terpene phenol resin.

In the present embodiment, the amorphous bioplastic is used as the binder resin. For example, amorphous polylactic acid can be used as the amorphous bioplastic.

An amorphous bioplastic is a bioplastic having no exothermic peak on a DSC curve obtained as a result of DSC (differential scanning calorimetry). On the other hand, a crystalline bioplastic is a bioplastic having an exothermic peak on the DSC curve.

Figure 1:
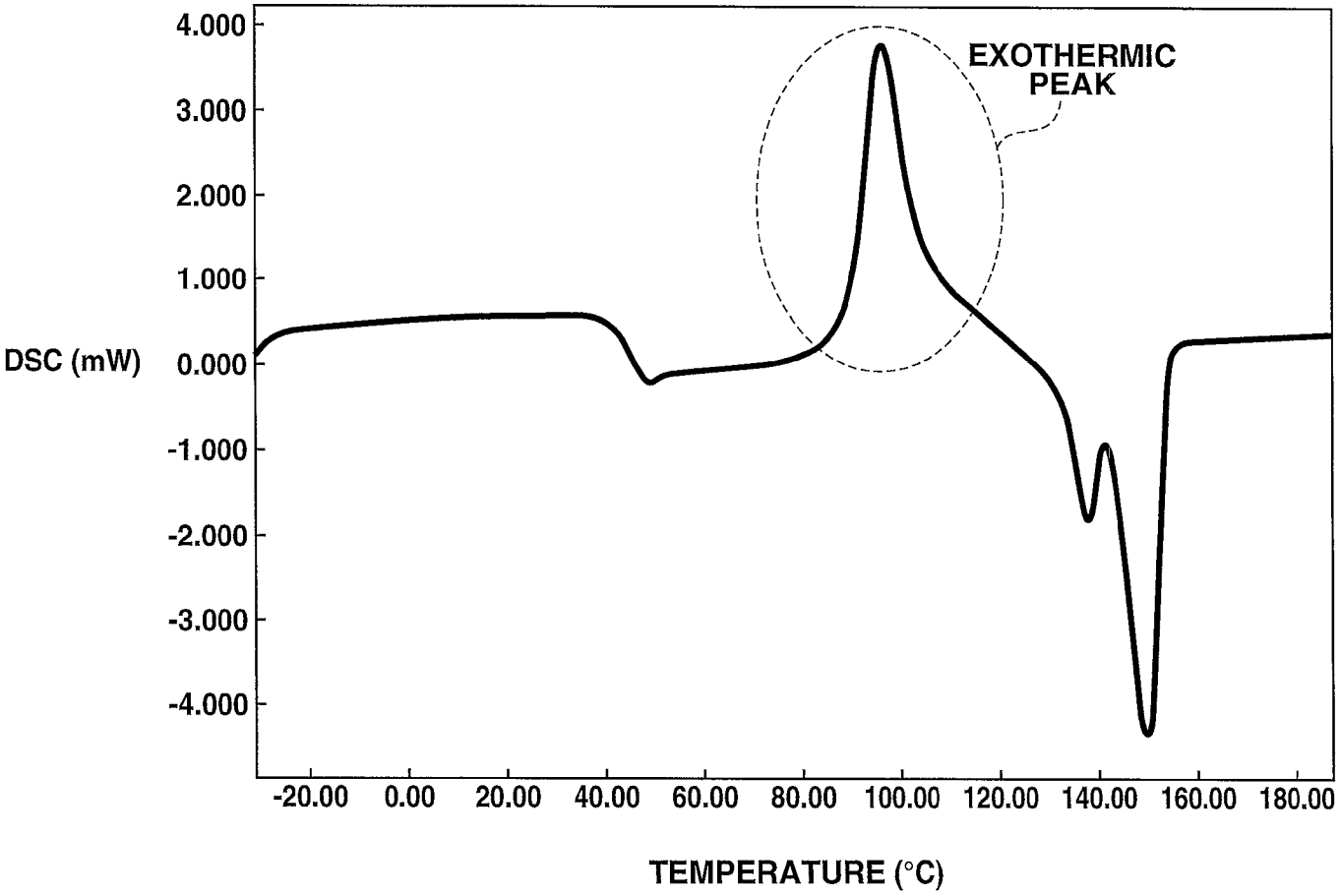
FIG.1 PRIOR ART
FIG. 1 shows a DSC (differential scanning calorimetry) curve of crystalline polylactic acid which is conventionally used widely.
Figure 2:
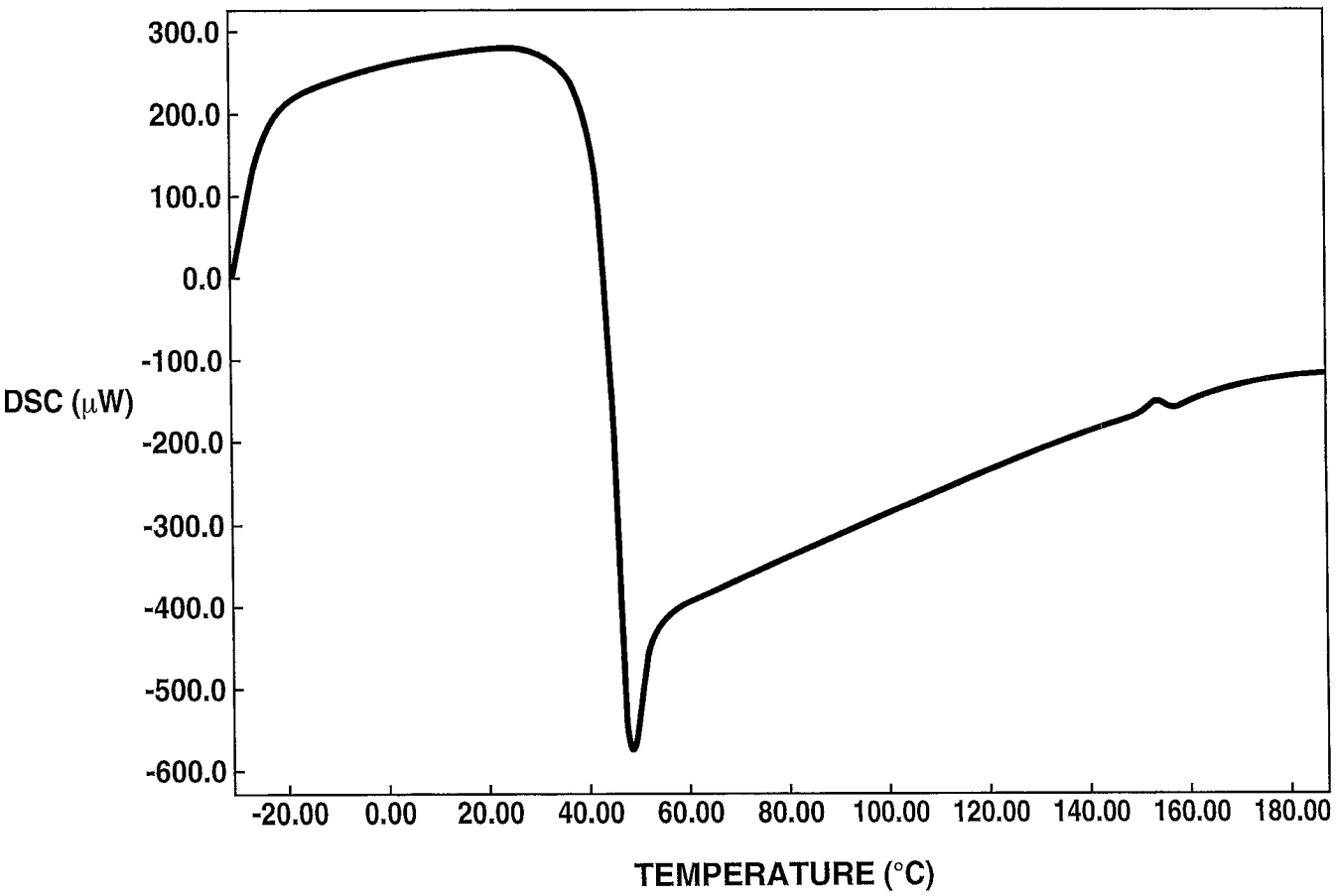
FIG. 2 shows a DSC (differential scanning calorimetry) curve of amorphous polylactic acid which can be used in the present invention.

FIG. 1 shows a DSC curve of crystalline polylactic acid which is conventionally used widely. FIG. 2 shows a DSC curve of amorphous polylactic acid which can be used in the present invention. As shown in FIGS. 1 and 2, an exothermic peak is observed on the DSC curve of the crystalline polylactic acid, and no exothermic peak is observed on the DSC curve of the amorphous polylactic acid.

Typically, a toner according to the present embodiment contains no crystalline bioplastic. One of the reasons for this is that crystalline bioplastic is harder than amorphous bioplastic, and has poorer grindability than that of amorphous bioplastic when the crystallinebioplastic has the same molecular weight as that of the amorphous bioplastic, for example.

The amorphous bioplastic has a weight average molecular weight (Mw) falling within a range of 30,000 to 100,000. The weight average molecular weight (Mw) preferably falls within a range of 50,000 to 80,000. A too-low weight average molecular weight (Mw) makes it impossible to maintain preservability and durability required as the toner. A too-high weight average molecular weight (Mw) results in poor grindability, which makes it difficult to produce the toner.

For example, the amorphous bioplastic is contained in a ratio of 20 to 80% by mass based on the mass of the toner. Herein, "the mass of the toner" is defined as the total mass of toner raw materials containing a binder resin, a grinding aid, and a colorant, and excludes the mass of an external additive such as silica.

The toner according to the present embodiment contains at least one of a phenol resin and a terpene phenol resin as the grinding aid. For example, a resin containing phenol and formaldehyde as raw materials can be used as the phenol resin. Specifically, CKM-2103 (manufactured by Showa Denko K.K.), CKM-2432 (manufactured by Showa Denko K.K.), and TD-2075A (manufactured by DIC corporation) or the like can be used.

For example, a resin obtained by copolymerizing a terpene monomer and phenol can be used as the terpene phenol resin. Specifically, there can be used YS Polystar N125 (manufactured by Yasuhara Chemical Co., Ltd.), YS Polystar K140 (manufactured by Yasuhara Chemical Co., Ltd.), YS Polystar G150 (manufactured by Yasuhara Chemical Co., Ltd.), and Sylvares TP 7042 (Arizona Chemical Company) or the like.

The weight-average degree of polymerization of the grinding aid preferably falls within a range of 500 to 5,000. When the degree of polymerization is too low, the heat characteristics of the entire toner are decreased. When the degree of polymerization is too high, the entire toner becomes hard, which makes it impossible to maintain grindability.

The use of the phenol resin alone as the grinding aid tends to provide higher fixability higher than that of terpene phenol resin used alone. The terpene phenol resin may be further used when the phenol resin is used as the grinding aid. In this case, the biodegradability of the entire toner is improved. This is considered to be caused by the biodegradability of a terpene monomer and a polymer thereof which are contained in the terpene phenol resin.

The total amount of the phenol resin and the terpene phenol resin falls within a range of 10 to 60% by mass of the mass of the toner, for example. When the total amount is small, an effect of improving grindability is not dominantly exhibited. When the total amount is large, the heat characteristics required as the toner are remarkably decreased, which reduces durability and fixability.

The total amount of the phenol resin and the terpene phenol resin preferably falls within a range of 10 to 30% by mass of the mass of the toner, and more preferably within a range of 20 to 25% by mass of the mass of the toner. When the total amount of the phenol resin and the terpene phenol resin falls within the range, better fixability can be attained.

The amount of the phenol resin preferably falls within a range of 5 to 20% by mass of the mass of the toner. When the amount of the phenol resin falls within the range, much better fixability can be attained.

The toner according to the present embodiment can further contain a colorant as a toner raw material. As the colorant, a conventionally known colorant can be used. Examples of a black colorant include carbon black; examples of a blue colorant include C. I. Pigment 15:3; examples of a red colorant include C. I. Pigments 57:1, 122, and 269; and examples of a yellow colorant include C. I. Pigments 74, 180, and 185. In consideration of effects on the environment, a colorant in itself having high safety is preferable.

The content of the colorant is preferably 1 to 10% by mass based on the mass of the toner. The colorant may be dispersed at a high concentration in a part of the binder resin so as to produce a master batch before melt-kneading the colorant with the binder resin or the like, and the master batch may be mixed with the remaining resin or the like.

To the toner according to the present embodiment, a conventionally known release agent can be added if needed. Examples of such a release agent include olefin-based wax such as polypropylene wax, polyethylene wax, or Fischer-Tropsch wax; natural wax such as carnauba wax, rice wax, or scale insect wax; and synthetic ester wax.

In order to improve low-temperature fixability and high-speed printing performance, a release agent having a comparatively low melting point of about 60 to about 100° C. is preferable. Specifically, the carnauba wax and the synthetic ester wax are preferable. In consideration of effects on the environment, natural product-based carnauba wax is more preferable. The amount of the release agent to be blended is preferably 1 to 15% by mass based on the mass of the toner.

To the toner according to the present embodiment, a conventionally known charge control agent can be added if needed as the raw material. Examples of a positive charge control agent include a resin containing a quarternary ammonium salt or an amino group. Examples of a negative charge control agent include a resin containing a metal complex salt of salicylic acid, a metal complex salt of benzilic acid, a calixarene type phenol-based condensate, or a carboxyl group. The amount of the charge control agent to be added is preferably 0.1 to 5% by mass based on the mass of the toner.

To the toner according to the present embodiment, a conventionally known resin for toners can be added if needed in addition to the bioplastic and the grinding aid. Examples of such a resin include a styrene resin, an acrylic resin, and a polyester resin. From the viewpoints of pigment dispersibility and low-temperature fixability, a polyester resin developed for toners is preferable. These resins may be used alone or as a mixture of two or more kinds. In consideration of effects on the environment, the amount of these resins to be blended is preferably 0 to 50% by mass based on the mass of the toner.

A low molecular weight resin can be added as another material in order to improve fixability or the like. Herein, examples of the low molecular weight resin include rosin, a rosin derivative, a polyterpene resin, and a petroleum resin. These are oligomer resins having a molecular weight of a few hundred to a few thousand, and commercially available as a tackifier.

To the toner according to the present embodiment, a conventionally known hydrolysis inhibitor can be added if needed. Examples of the hydrolysis inhibitor include a carbodiimide-based compound, an isocyanate-based compound, and an oxazoline-based compound. Such a hydrolysis inhibitor can block a terminal hydroxyl or carboxyl group generated by the residual monomer or the decomposition, to suppress a hydrolysis chain reaction.

Carbodilite LA-1 (manufactured by Nisshinbo Industries, Inc.) or the like, which is a polycarbodiimide compound, is commercially available as the hydrolysis inhibitor. The amount of the hydrolysis inhibitor to be added is preferably 0.01 to 15% by mass, and more preferably 1 to 10% by mass based on the bioplastic.

To the toner according to the present embodiment, a conventionally known nucleating agent can be added if needed. Examples of the nucleating agent include an inorganic nucleating agent such as talc, and an organic nucleating agent such as an organic carboxylic acid metal salt such as sodium benzoate, a phosphoric ester metal salt, benzylidene sorbitol, or carboxylic amide.

The electrophotographic toner described above can be produced by the following method, for example.

First, mixed are raw materials including a binder resin containing an amorphous bioplastic, a grinding aid containing at least one of a phenol resin and a terpene phenol resin, a colorant, and another additive if needed. Then, this is kneaded in a kneading machine such as a twin shaft kneader, a press kneader, or an open roll kneader, to obtain a kneaded product. After the obtained kneaded product is cooled, the kneaded product is ground in a grinder such as a jet mill, and classified by an air classifier or the like, and thereby a toner can be obtained. Herein, the particle diameter of the toner is not particularly limited. The particle diameter is usually adjusted to 5 to 10 μm.

To the toner thus obtained, an external additive can be added in order to improve flowability, to adjust an electrostatic property, and to improve durability. Inorganic fine particles are generally used as the external additive. Examples of the external additive include silica, titania, and alumina. Among them, silica subjected to a hydrophobizing treatment (commercially available from Nippon AEROSIL, Co., Ltd. and CABOT, Inc.) is preferable. The inorganic fine particles preferably have a primary particle diameter of 7 to 40 nm. Two or more kinds of the inorganic fine particles may be mixed in order to improve a function.

EXAMPLES

Hereinafter, Examples of the present invention and Comparative Examples will be shown. The present invention will be more specifically described.

In Examples and Comparative Examples, amorphous polylactic acid was used as an amorphous bioplastic. Specifically, amorphous polylactic acids having weight average molecular weights (Mw) of about 55,000, about 80,000, and about 120,000 were used. In these amorphous polylactic acids, an exothermic peak was not observed on a DSC curve as in the amorphous polylactic acid shown in FIG. 2.

Production of Toner

Example 1

There were used 61 parts by mass of an amorphous polylactic acid resin "Vyloecol BE-400" (manufactured by Toyobo Co., Ltd.) having a weight average molecular weight (Mw) of 80,000 as a binder resin, 20 parts by mass of a phenol resin "CKM-2105" (manufactured by Showa Denko K.K.) as a grinding aid, 12 parts by mass of a master batch containing magenta R269 at a concentration of 40% as a colorant, 6 parts by mass of "Carnauba wax No. 1 powder" (manufactured by Nihon Wax) as a release agent, and 1 part by mass of "LR-147" (manufactured by Japan Carlit Co., Ltd.) as a charge control agent. These were measured to 30 kg in total, and mixed in a Henschel mixer having a volume of 150 L.

The obtained mixture was melt-kneaded in a twin screw extruder (screw diameter: 43 mm, L/D=34), and the melt-kneaded product was then drawn and cooled for hardening with circulating water of a mill roll set to 10° C. The hardened product was coarsely ground in a "Rotoplex" (manufactured by Hosokawa Micron Corporation, 2 mm screen).

Then, grinding and classification were performed so that the average particle diameter of a toner was set to 7.5 μm by a collision type grinder "UFS-2" (manufactured by Nippon Pneumatic Mfg. Co., Ltd.) and an air classifier "UFC-2" (manufactured by Nippon Pneumatic Mfg. Co., Ltd.), to obtain colored fine particles.

To 100 parts by mass of the obtained colored fine particles, 2.5 parts by mass of hydrophobic silica "RY50" (manufactured by Nippon Aerosil Co., Ltd.) having a primary particle diameter of 40 nm, 0.8 part by mass of hydrophobic silica "TG-810G" (manufactured by Cabot Corporation) having a primary particle diameter of 7 nm, and 1.3 parts by mass of hydrophobic silica "TG-C190" (manufactured by Cabot Corporation) having a primary particle diameter of 115 nm were added as external additives. These were mixed in a Henschel mixer, and then sieved to obtain an electrophotographic toner.

Example 2

A toner was produced in the same manner as in Example 1 except that 20 parts by mass of a phenol resin "CKM-2432" (manufactured by Showa Denko K.K.) was used as a grinding aid.

Example 3

A toner was produced in the same manner as in Example 1 except that 56 parts by mass of a binder resin was used, and 5 parts by mass of a phenol resin "CKM-2103" and 20 parts by mass of a terpene phenol resin "YS Polystar N125" (manufactured by Yasuhara Chemical Co., Ltd.) were used as a grinding aid.

Example 4

A toner was produced in the same manner as in Example 1 except that 56 parts by mass of a binder resin was used, and 5 parts by mass of a phenol resin "CKM-2432" and 20 parts by mass of a terpene phenol resin "YS Polystar K140" (manufactured by Yasuhara Chemical Co., Ltd.) were used as a grinding aid.

Example 5

A toner was produced in the same manner as in Example 1 except that 56 parts by mass of a binder resin was used, and 5 parts by mass of a phenol resin "CKM-2103" and 20 parts by mass of a terpene phenol resin "YS Polystar G150" (manufactured by Yasuhara Chemical Co., Ltd.) were used as a grinding aid.

Example 6

A toner was produced in the same manner as in Example 1 except that 71 parts by mass of a binder resin was used, and 10 parts by mass of a terpene phenol resin "YS Polystar N125" was used as a grinding aid.

Example 7

A toner was produced in the same manner as in Example 1 except that 71 parts by mass of a binder resin was used, and 10 parts by mass of a terpene phenol resin "YS Polystar K140" was used as a grinding aid.

Example 8

A toner was produced in the same manner as in Example 1 except that 71 parts by mass of a binder resin was used, and 10 parts by mass of a terpene phenol resin "YS Polystar G150" was used as a grinding aid.

Example 9

A toner was produced in the same manner as in Example 1 except that 71 parts by mass of an amorphous polylactic acid resin "Vyloecol BE-405" (manufactured by Toyobo Co., Ltd.) having a weight average molecular weight (Mw) of 55,000 was used as a binder resin, and 10 parts by mass of a terpene phenol resin "YS Polystar N125" was used as a grinding aid.

Example 10

A toner was produced in the same manner as in Example 1 except that 30 parts by mass of a terpene phenol resin "YS Polystar N125" was used as a grinding aid.

Example 11

A toner was produced in the same manner as in Example 1 except that 30 parts by mass of a terpene phenol resin "YS Polystar K140" was used as a grinding aid.

Example 12

A toner was produced in the same manner as in Example 1 except that 30 parts by mass of a terpene phenol resin "YS Polystar G150" was used as a grinding aid.

Example 13

A toner was produced in the same manner as in Example 1 except that 61 parts by mass of an amorphous polylactic acid resin having a weight average molecular weight (Mw) of 55,000 was used as a binder resin, and 30 parts by mass of a terpene phenol resin "YS Polystar N125" was used as a grinding aid.

Example 14

A toner was produced in the same manner as in Example 1 except that 21 parts by mass of a binder resin was used, and 60 parts by mass of a grinding aid was used.

Example 15

A toner was produced in the same manner as in Example 1 except that 41 parts by mass of an amorphous polylactic acid resin having a weight average molecular. weight (Mw) of 55,000 was used as a binder resin, and 40 parts by mass of a phenol resin "CKM-2432" was used as a grinding aid.

Example 16

A toner was produced in the same manner as in Example 1 except that 21 parts by mass of an amorphous polylactic acid resin having a weight average molecular weight (Mw) of 55,000 was used as a binder resin, and 60 parts by mass of a phenol resin "CKM-2432" was used as a grinding aid.

Example 17

A toner was produced in the same manner as in Example 1 except that 41 parts by mass of an amorphous polylactic acid resin having a weight average molecular weight (Mw) of 55,000 was used as a binder resin, and 40 parts by mass of a phenol resin "CKM-2103" was used as a grinding aid.

Comparative Example 1

A toner was produced in the same manner as in Example 1 except that 81 parts by mass of a binder resin was used, and a grinding aid was not used.

Comparative Example 2

A toner was produced in the same manner as in Example 1 except that 81 parts by mass of an amorphous polylactic acid resin having a weight average molecular weight (Mw) of 55,000 was used as a binder resin, and a grinding aid was not used.

Comparative Example 3

A toner was produced in the same manner as in Example 1 except that 20 parts by mass of a rosin ester resin "Pencel D135" (manufactured by Arakawa Chemical Industries, Ltd.) was used as a grinding aid.

Comparative Example 4

A toner was produced in the same manner as in Example 1 except that 20 parts by mass of a rosin ester resin "Pencel A" (manufactured by Arakawa Chemical Industries, Ltd.) was used as a grinding aid.

Comparative Example 5

A toner was produced in the same manner as in Example 1 except that 20 parts by mass of a rosin ester resin "Pencel D150" (manufactured by Arakawa Chemical Industries, Ltd.) was used as a grinding aid.

Comparative Example 6

A toner was produced in the same manner as in Example 1 except that 20 parts by mass of a rosin ester resin "Hariester KW" manufactured by Harima Chemicals, Inc.) was used as a grinding aid.

Comparative Example 7

A toner was produced in the same manner as in Example 1 except that 41 parts by mass of a binder resin was used, and 40 parts by mass of a rosin ester resin "Pencel D135" was used as a grinding aid.

Comparative Example 8

A toner was produced in the same manner as in Example 1 except that 21 parts by mass of a binder resin was used, and 60 parts by mass of a rosin ester resin "Pencel D135" was used as a grinding aid.

Comparative Example 9

A toner was produced in the same manner as in Example 1 except that 61 parts by mass of an amorphous polylactic acid resin "Vyloecol BE-400" (manufactured by Toyobo Co., Ltd.) having a weight average molecular weight (Mw) of 120,000 was used as a binder resin.

Comparative Example 10

A toner was produced in the same manner as in Example 1 except that 61 parts by mass of an amorphous polylactic acid resin having a weight average molecular weight (Mw) of 120,000 was used as a binder resin, and 20 parts by mass of a phenol resin "CKM-2432" was used as a grinding aid.

Each of the produced toners was measured and evaluated according to the following method.

1. Grindability

The toner was evaluated based on the following according to a feed amount when grinding and classification were performed using the collision type grinder "UFS-2" (manufactured by Nippon Pneumatic Mfg. Co., Ltd.) and the wind-force classifying machine "UFC-2" (manufactured by Nippon Pneumatic Mfg. Co., Ltd.).

A: 5 Kg/hr or more

B: more than 3 kg/hr and less than 5 kg/hr

C: 3 kg/hr or less

2. Fixability

The obtained toner was set in a printer "GE6000" (manufactured by Casio Computer Co., Ltd.), and a fixing temperature was changed by 5° C. from 120° C. to 190° C. A 100% solid image was successively printed on ten sheets at each temperature. Fixing offset was confirmed to occur during printing at each temperature. The width of a temperature range in which the offset did not occur was evaluated according to the following basis.

S: 65° C. or more

A: 50° C. or more and 65° C. or less

B: 35° C. or more and 45° C. or less

C: 30° C. or less

3. Durability

The obtained toner was set in a printer "GE6000" (manufactured by Casio Computer Co., Ltd.), and 40,000 sheets were subjected to intermittent printing of 5 sheets with a printing image of 1.7%. On the way, a sample image was printed for 5,000 sheets. The amount of lines occurring on the image was evaluated on the following basis.

A: No line was observed.

B: Several lines were observed.

C: Many lines were observed.

4. Comprehensive Results

The comprehensive results were evaluated by synthesizing the evaluations of the items 1 to 3.

The above results are summarized in Tables 1 and 2.

TABLE 1

| | Composition of base material of tonner (parts by mass) | | | | | | | | | | |
|---|---|---|---|---|---|---|---|---|---|---|---|
| | | | | Grinding aid | | | | | | | |
| | Binder resin PLA resin | | | Phenol resin | | Terpene phenolic resin | | | Colorant | Release agent | Charge control |
| | Mw: 120,000 | Mw: 80,000 | Mw: 55,000 | CKM-2013 | CKM-2432 | YS Polustar K125 | YS Polustar K140 | YS Polustar G150 | 40% magenta master batch | Carnauba wax | agent IR-147 |
| Ex. 1 | | 61 | | 20 | | | | | 12 | 6 | 1 |
| Ex. 2 | | 61 | | | 20 | | | | 12 | 6 | 1 |
| Ex. 3 | | 56 | | 5 | | 20 | | | 12 | 6 | 1 |
| Ex. 4 | | 56 | | | 5 | | 20 | | 12 | 6 | 1 |
| Ex. 5 | | 56 | | 5 | | | | 20 | 12 | 6 | 1 |
| Ex. 6 | | 71 | | | | 10 | | | 12 | 6 | 1 |
| Ex. 7 | | 71 | | | | | 10 | | 12 | 6 | 1 |

TABLE 1-continued

| | | | | | | | | | | |
|---|---|---|---|---|---|---|---|---|---|---|
| Ex. 8 | 71 | | | | | 10 | 12 | 6 | 1 |
| Ex. 9 | | 71 | | 10 | | | 12 | 6 | 1 |
| Ex. 10 | 61 | | | 30 | | | 12 | 6 | 1 |
| Ex. 11 | 61 | | | | 30 | | 12 | 6 | 1 |
| Ex. 12 | 61 | | | | | 30 | 12 | 6 | 1 |
| Ex. 13 | | 61 | | 30 | | | 12 | 6 | 1 |
| Ex. 14 | 21 | | 60 | | | | 12 | 6 | 1 |

| | Amount of external additive (parts by mass based on 100 parts by mass of base material of tonner) Hydrophobic silica | | | Evaluation | | | |
|---|---|---|---|---|---|---|---|
| | RY50 | TG810G | TG-C190 | Productivity | Performance | | |
| | (40 nm) | (7 nm) | (115 nm) | Grindability | Fixability | Durability | Total |
| Ex. 1 | 2.5 | 0.3 | 1.3 | A | S | A | S |
| Ex. 2 | 2.5 | 0.3 | 1.3 | A | S | A | S |
| Ex. 3 | 2.5 | 0.3 | 1.3 | A | S | A | S |
| Ex. 4 | 2.5 | 0.3 | 1.3 | A | S | A | S |
| Ex. 5 | 2.5 | 0.3 | 1.3 | A | S | A | A |
| Ex. 6 | 2.5 | 0.3 | 1.3 | A | A | A | A |
| Ex. 7 | 2.5 | 0.3 | 1.3 | A | A | A | A |
| Ex. 8 | 2.5 | 0.3 | 1.3 | A | A | A | A |
| Ex. 9 | 2.5 | 0.3 | 1.3 | A | A | A | A |
| Ex. 10 | 2.5 | 0.3 | 1.3 | A | A | A | A |
| Ex. 11 | 2.5 | 0.3 | 1.3 | A | A | A | A |
| Ex. 12 | 2.5 | 0.3 | 1.3 | A | A | A | A |
| Ex. 13 | 2.5 | 0.3 | 1.3 | A | A | A | A |
| Ex. 14 | 2.5 | 0.3 | 1.3 | A | A | A | A |

TABLE 2

| | Composition of base material of tonner (parts by mass) | | | | | | | | | | | |
|---|---|---|---|---|---|---|---|---|---|---|---|---|
| | | | | Grinding aid | | | | | | | | |
| | Binder resin PLA resin | | | Phenol resin | | Rosin ester resin | | | | Colorant | Release agent | Charge control |
| | Mw: 120,000 | Mw: 80,000 | Mw: 55,000 | CKM-2013 | CKM-2432 | PENSEL D135 | PENSEL A | PENSEL D150 | HARIESTER KW | 40% magenta master batch | Carnauba wax | agent IR-147 |
| Ex. 15 | | | 41 | | 40 | | | | | 12 | 6 | 1 |
| Ex. 16 | | | 21 | | 60 | | | | | 12 | 6 | 1 |
| Ex. 17 | | | 41 | 40 | | | | | | 12 | 6 | 1 |
| Comp. ex. 1 | | 81 | | | | | | | | 12 | 6 | 1 |
| Comp. ex. 2 | | | 81 | | | | | | | 12 | 6 | 1 |
| Comp. ex. 3 | | 61 | | | | 20 | | | | 12 | 6 | 1 |
| Comp. ex. 4 | | 61 | | | | | 20 | | | 12 | 6 | 1 |
| Comp. ex. 5 | | 61 | | | | | | 20 | | 12 | 6 | 1 |
| Comp. ex. 6 | | 61 | | | | | | | 20 | 12 | 6 | 1 |
| Comp. ex. 7 | | 41 | | | | 40 | | | | 12 | 6 | 1 |
| Comp. ex. 8 | | 21 | | | | 60 | | | | 12 | 6 | 1 |
| Comp. ex. 9 | 61 | | | 20 | | | | | | 12 | 6 | 1 |
| Comp. ex. 10 | 61 | | | | 20 | | | | | 12 | 6 | 1 |

TABLE 2-continued

| | Amount of external additive (parts by mass based on 100 parts by mass of base material of tonner) Hydrophobic silica | | | Evaluation | | | |
|---|---|---|---|---|---|---|---|
| | RY50 | TG810G | TG-C190 | Productivity | Performance | | |
| | (40 nm) | (7 nm) | (115 nm) | Grindability | Fixability | Durability | Total |
| Ex. 15 | 2.5 | 0.3 | 1.3 | A | A | A | A |
| Ex. 16 | 2.5 | 0.3 | 1.3 | A | A | A | A |
| Ex. 17 | 2.5 | 0.3 | 1.3 | A | A | A | A |
| Comp. ex. 1 | 2.5 | 0.3 | 1.3 | C | — | — | C |
| Comp. ex. 2 | 2.5 | 0.3 | 1.3 | C | — | — | C |
| Comp. ex. 3 | 2.5 | 0.3 | 1.3 | C | — | — | C |
| Comp. ex. 4 | 2.5 | 0.3 | 1.3 | C | — | — | C |
| Comp. ex. 5 | 2.5 | 0.3 | 1.3 | C | — | — | C |
| Comp. ex. 6 | 2.5 | 0.3 | 1.3 | C | — | — | C |
| Comp. ex. 7 | 2.5 | 0.3 | 1.3 | B | C | C | C |
| Comp. ex. 8 | 2.5 | 0.3 | 1.3 | B | C | C | C |
| Comp. ex. 9 | 2.5 | 0.3 | 1.3 | C | — | — | C |
| Comp. ex. 10 | 2.5 | 0.3 | 1.3 | C | — | — | C |

As shown in Table 1, Examples 1 to 17 attained good performance for all of grindability, fixability, and durability. In particular, Examples 1 to 5 attained better fixability than that of Examples 6 to 17.

As is clear by comparing Examples 1 to 8, 10 to 12, and 14 with Comparative Example 1, and comparing Examples 9, 13, and 15 to 17 with Comparative Example 2, the grinding aid was indispensable in obtaining sufficient grindability.

As is clear from comparing Examples 1, 2, and 10 to 12 with Comparative Examples 3 to 6, the phenol resin, the terpene phenol resin, or the combination thereof was suitably used as the grinding aid. As is clear from Comparative Examples 3, 7, and 8, when the rosin ester resin was used as the grinding aid, and the amount of the rosin ester resin was increased, a certain level of grindability could be attained. However, sufficient fixability and durability could not be attained.

As is clear from comparing Examples 1 and 2 with Comparative Examples 9 and 10, even if the phenol resin, the terpene phenol resin, or the combination thereof was used as the grinding aid when the molecular weight of the polylactic acid was large, sufficient grindability could not be attained.

Having described and illustrated the principles of this application by reference to one preferred embodiment, it should be apparent that the preferred embodiment may be modified in terms of arrangement and details without departing from the principles disclosed herein, and that the application should be construed as including all such modifications and variations insofar as they come within the spirit and scope of the subject matter disclosed herein.

The invention claimed is:

1. An electrophotographic toner comprising:

an amorphous polylactic acid having a weight average molecular weight (Mw) of 30,000 to 47,500; and a grinding aid which is at least one resin selected from the group consisting of a phenol resin and a terpene phenol resin.

2. The electrophotographic toner according to claim 1, wherein a total amount of the grinding aid falls within a range of 10 to 60% by mass of a mass of the toner.

3. The electrophotographic toner according to claim 2, wherein the total amount of the grinding aid falls within a range of 10 to 30% by mass of the mass of the toner.

4. The electrophotographic toner according to claim 3, wherein the total amount of the grinding aid falls within a range of 20 to 25% by mass of the mass of the toner.

5. The electrophotographic toner according to claim 1, wherein the grinding aid comprises the phenol resin, and an amount of the phenol resin falls within a range of 5 to 20% by mass of a mass of the toner.

6. The electrophotographic toner according to claim 1, wherein the phenol resin or the terpene phenol resin has a weight-average degree of polymerization falling within a range of 500 to 5,000.

7. The electrophotographic toner according to claim 1, wherein the toner comprises both the phenol resin and the terpene phenol resin as the grinding aid.

8. The electrophotographic toner according to claim 7, wherein an amount of the phenol resin falls within a range of 5 to 20% by mass of a mass of the toner.

9. A method of producing the electrophotographic toner according to claim 1, comprising:

melt-kneading a mixture comprising the amorphous polylactic acid having a weight average molecular weight (Mw) of 30,000 to 47,500 and the grinding aid which is at least one resin selected from the group consisting of a phenol resin and a terpene phenol resin to obtain a kneaded product; and grinding the kneaded product after the kneaded product has hardened.

* * * * *